US006128463A

United States Patent [19]

Matsumoto et al.

[11] Patent Number: 6,128,463

[45] **Date of Patent: *Oct. 3, 2000**

[54] IMAGE FORMING DEVICE

[75] Inventors: Yoshiya Matsumoto; Shigeo Nonoyama; Tetsuya Takei; Nobuo Kuwabara; Hiroshi Kera; Takefumi Takahashi; Yoshio Yamaguchi; Akira Nagahara, all of Kawasaki, Japan

[73] Assignee: Fujitsu Limited, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/865,770

[22] Filed: May 30, 1997

[30] Foreign Application Priority Data

Dec. 12, 1996 [JP] Japan ..... 8-332318

[51] Int. Cl.[7] ..... G03G 15/00

[52] U.S. Cl. ..... 399/364; 399/381; 399/397

[58] Field of Search ..... 399/315, 361, 399/364, 397, 401, 405, 381, 398

[56] References Cited

U.S. PATENT DOCUMENTS

| | | | |
|---|---|---|---|
| 4,238,126 | 12/1980 | Langdon | 271/3.1 |
| 4,573,789 | 3/1986 | Wada . | |
| 4,676,627 | 6/1987 | Ohno . | |
| 4,780,745 | 10/1988 | Kodama | 399/401 |
| 4,928,150 | 5/1990 | Hatta . | |
| 4,945,390 | 7/1990 | Hasegawa et al. | 399/405 |
| 5,257,035 | 10/1993 | Funahashi et al. | 399/401 X |
| 5,381,216 | 1/1995 | Osaka et al. | 399/315 |
| 5,418,607 | 5/1995 | Tani | 399/364 |
| 5,448,348 | 9/1995 | Azeta | 399/364 |

FOREIGN PATENT DOCUMENTS

| | | |
|---|---|---|
| 0 729 081 A1 | 8/1996 | European Pat. Off. . |
| 4-199174 | 7/1992 | Japan . |
| 7-36287 | 2/1995 | Japan . |
| 7-84462 | 3/1995 | Japan . |

OTHER PUBLICATIONS

European Search Reoprt dated May 22, 1998 for Application No. 97304842.4.

*Primary Examiner*—Sandra Brase
*Attorney, Agent, or Firm*—Armstrong, Westerman, Hattori, McLeland & Naughton

[57] ABSTRACT

An image forming device includes an image forming part which forms an image on a recording medium; a recording medium switchback portion which receives the recording medium on a first run, one side of which has been printed when passing the image forming part, and sends the recording medium for a second run; a recording medium path which communicates with the recording medium switchback portion so as to send the recording medium to and from the recording medium switchback portion; an inverted recording medium transfer path through which the recording medium is sent to the image forming part again with an upper surface and a lower surface of the recording medium reversed; and a recording medium transfer part which transfers the recording medium along the inverted recording medium transfer path. The image forming device is further provided with a first recording medium receiving portion which stores the recording medium one on another with a printed surface facing upwards; and a first recording medium ejection path which communicates with the recording medium receiving portion so as to send the recording medium to the first recording medium receiving portion.

21 Claims, 11 Drawing Sheets

FIG.10A
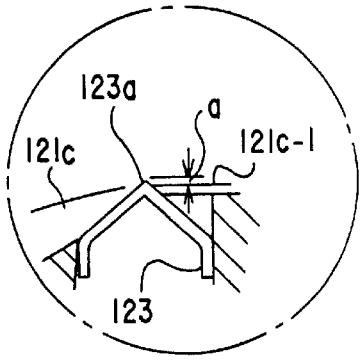
FIG.10
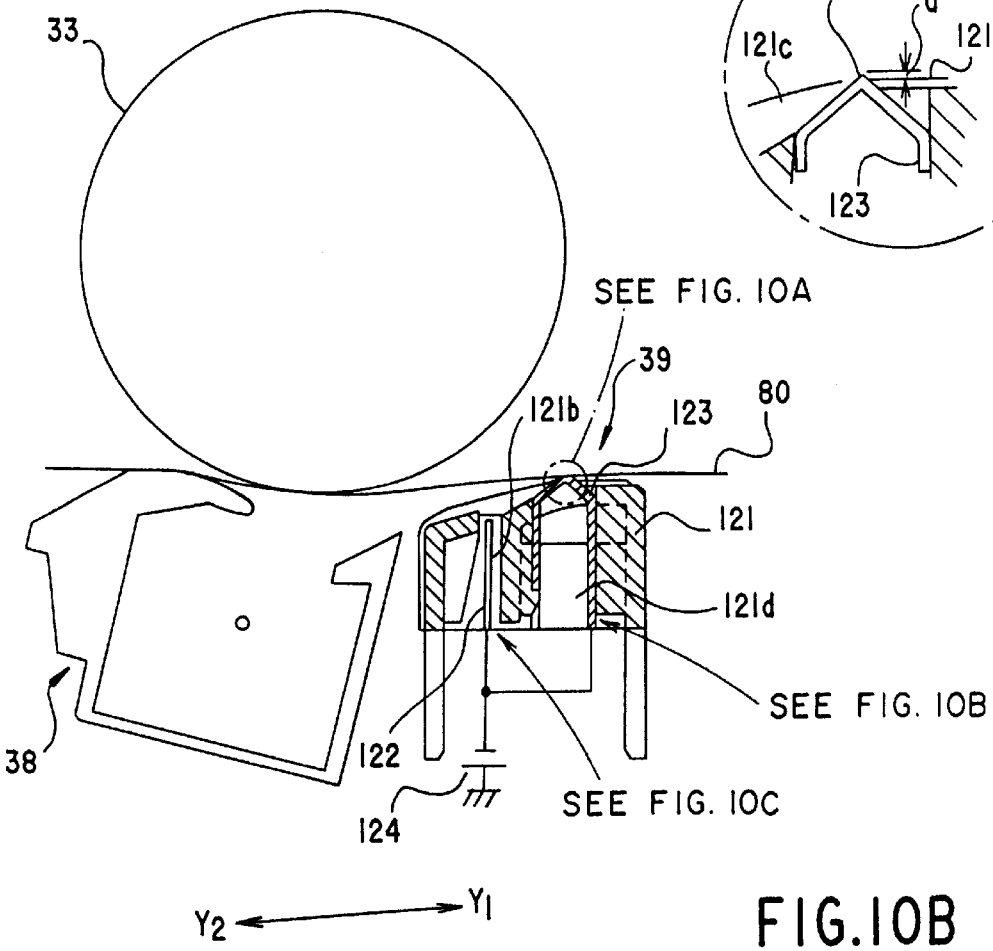
FIG.10B
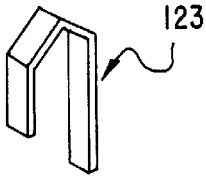
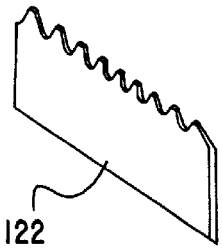
FIG.10C

IMAGE FORMING DEVICE

BACKGROUND OF THE INVENTION

1. Field of the Invention

The present invention generally relates to image forming devices, and particularly, to an image forming device such as a dual-sided printer and a duplicator which is capable of both-side printing as well as one-side printing.

2. Description of the Related Art

FIG. 1 is a schematic diagram showing a conventional dual-sided printer 10 which is capable of both-side printing. The dual-sided printer 10 is comprised of a photoreceptor drum 11, a face-down stacker 12 which is located above the photoreceptor drum 11, a recording medium switchback portion 13 which is located in a side direction of the photoreceptor drum 11, a recording medium ejection path 14, a manual paper inlet through which a recording medium 92 (93) is introduced, and a paper cartridge 17. The face-down stacker 12 is capable of storing printed papers with a latest printed surface facing downward, i.e., the stacker 12 is capable of storing the printed papers in order of page numbers without requiring large memory. The recording medium switchback portion 13 functions as a transfer means for receiving a paper, one surface (upper surface) of which is printed by passing the photoreceptor drum 11, and transfers the paper in the reversed direction in order to perform a printing of the other side of the paper.

In the dual-sided printer 10, the both-side printing is carried out as follows. When a paper is fed from the paper cartridge 17 in the direction A shown in FIG. 1, it is passed underneath the photoreceptor drum 11 as indicated by the arrow B and its upper surface is printed. Then, the paper is transferred in the direction C and reaches the recording medium switchback portion 13. At the recording medium switchback portion 13, the direction of the paper transfer is reversed and it is fed in the direction indicated by the arrows D and E towards a position underneath the paper cartridge 17 (the movement of a paper from the paper cartridge 17 to the position underneath the paper cartridge 17 is hereinafter referred to as a first run of the paper). The position of the paper which may be shifted during the first run may be adjusted by a paper position adjusting mechanism (not shown). After this, the paper is transferred in the direction indicated by the arrow F and passed again underneath the photoreceptor drum 11 so that the other side of the paper is printed. The paper, both sides of which are printed, is then moved in the direction indicated by the arrow G and is stored on the face-down stacker 12 (the movement of a paper from the position underneath the paper cartridge 17 to the face-down stacker 12 is hereinafter referred to as a second run of the paper).

In a case that only one side of the paper is necessary to be printed, a paper is transferred in a sequence as indicated by the arrows A→B→G and ejected to the face-down stacker.

Since the face-down stacker 12 is located above the photoreceptor drum 11, the recording medium ejection path 14 is curved in an arc shape and the paper passed underneath the photoreceptor drum 11 is transferred through the ejection path 14 in a curved state to the face-down stacker 12.

Now, there are cases that a recording medium having a relatively high strength or rigidity, such as a postcard, an OHP sheet or an envelope, is put through the manual paper inlet to the dual-sided printer 10 so that one side of the recording medium is printed with names, addresses, articles and so on. This kind of use of a dual-sided printer is occasionally required and is nothing uncommon.

However, in the conventional dual-sided printer 10, the recording medium having a relatively high strength does not curve easily in accordance with the shape of the ejection path 14 after one side of which is printed by passing underneath the photoreceptor drum 11. Thus, the transfer of the recording medium to the face-down stacker 12 may not be carried out smoothly and sometimes a jamming of recording media occurs. That is, it is not easy to perform one-side printing for a recording medium having a high rigidity using the conventional dual-sided printer 10.

SUMMARY OF THE INVENTION

Accordingly, it is a general object of this invention to provide an image forming device in which the above-mentioned problems are solved.

A more specific object of the present invention is to provide an image forming device by which a transfer of a recording medium to a stacker may be carried out smoothly and a jamming of the recording media does not occur.

Another object of the present invention is to provide a paper allotting mechanism used in the image forming device by which a recording medium is allotted to one of a recording medium ejection path which communicates with a face-down stacker, a recording medium ejection path which communicates with a face-up stacker, and a recording medium path which communicates with a recording medium switchback portion.

Yet another object of the present invention is to provide a static elimination means used in the image forming device by which an electric charge on a recording medium is removed and a printing quality is improved.

The objects described above are achieved by an image forming device comprising: an image forming part which forms an image on a recording medium; a recording medium switchback portion which receives the recording medium on a first run, one side of which has been printed when passing the image forming part, and sends the recording medium for a second run; a recording medium path which communicates with the recording medium switchback portion so as to send the recording medium to and from the recording medium switchback portion; an inverted recording medium transfer path through which the recording medium is sent to the image forming part again with an upper surface and a lower surface of the recording medium reversed; and a recording medium transfer part which transfers the recording medium along the inverted recording medium transfer path; further provided with a first recording medium receiving portion which stores the recording medium one on another with a printed surface facing upwards; and a first recording medium ejection path which communicates with the recording medium receiving portion so as to send the recording medium to the first recording medium receiving portion.

The objects described above are also achieved by the image forming device wherein the first recording medium receiving portion is a face-up stacker.

The objects described above are also achieved by the image forming device, further provided with a second recording medium receiving portion which stores the recording medium one on another with a latest printed surface facing downwards; and a second recording medium ejection path which communicates with the second recording medium receiving portion so as to send the recording medium to the second recording medium receiving portion.

The objects described above are also achieved by the image forming device wherein the second recording medium receiving portion is a face-down stacker.

According to the above image forming device, since the first recording medium receiving portion (face-up stacker) which may store the recording medium one on another with a printed surface facing upwards and a first recording medium ejection path which communicates with the first recording medium receiving portion (face-up stacker) are provided, a printing operation on a recording medium having high rigidity such as a postcard, an OHP sheet or an envelope may be properly carried out using the face-up stacker and the recording medium ejection path communicates with the face-up stacker. Thus, a dual-sided printer which is also capable of printing on the recording medium having high rigidity may be realized.

The objects described above are also achieved by the image forming device wherein the first recording medium receiving portion is located above the recording medium switchback portion and the first recording medium ejection path which communicates with the first recording medium receiving portion is located between the second recording medium ejection path which communicates with the second recording medium receiving portion and the recording medium path which communicates with the recording medium switchback portion, the first recording medium ejection path which communicates with the first recording medium receiving portion having substantially a straight shape.

According to the above image forming device, since the first recording medium receiving portion (face-up stacker) is located above the recording medium switchback portion and the first recording medium ejection path which communicates with the first recording medium receiving portion (face-up stacker) has substantially a straight form, a printing operation on a recording medium having high rigidity such as a post card, an OHP sheet or an envelope may be carried out without forcing the recording medium to bend through the recording medium ejection path. Thus, a jamming of the recording media does not occur and the paper ejection operation to the first paper receiving portion (face-up stacker) may be performed smoothly.

The objects described above are achieved by an image forming device comprising: an image forming part which forms an image on a recording medium; a recording medium switchback portion which receives the recording medium on a first run, one side of which has been printed when passing the image forming part, and sends the recording medium for a second run; a recording medium path which communicates with the recording medium switchback portion so as to send the recording medium to and from the recording medium switchback portion; an inverted recording medium transfer path through which the recording medium is sent to the image forming part again with an upper surface and a lower surface of the recording medium reversed; a recording medium transfer part which transfers the recording medium along the inverted recording medium transfer path; a first recording medium receiving portion which stores the recording medium one on another with a printed surface facing upwards; a first recording medium ejection path having a substantially straight shape which communicates with the first recording medium receiving portion so as to send the recording medium to the first recording medium receiving portion; a second recording medium receiving portion which stores the recording medium one on another with a latest printed surface facing downwards; a second recording medium ejection path which communicates with the second recording medium receiving portion so as to send the recording medium to the second recording medium receiving portion; and a paper allotting means which is capable of allotting the recording medium to one of the first recording medium ejection path which communicates with the first recording medium receiving portion, the second recording medium ejection path which communicates with the second recording medium receiving portion, and the recording medium path which communicates with the recording medium switchback portion.

The objects described above are also achieved by the image forming device wherein the first recording medium receiving portion is a face-up stacker.

The objects described above are also achieved by the image forming device wherein the second recording medium receiving portion is a face-down stacker.

According to the above image forming device, since the paper allotting means which is capable of allotting the recording medium to one of the first recording medium ejection path which communicates with the first recording medium receiving portion (face-up stacker), the second recording medium ejection path which communicates with the second recording medium receiving portion (face-down stacker), and the recording medium path which communicates with the recording medium switchback portion is provided, a printing operation on a recording medium having high rigidity such as a postcard, an OHP sheet or an envelope may be properly carried out by switching the paper allotting means to the first recording medium ejection path which communicates with the first recording medium receiving portion (face-up stacker). Thus, a dual-sided printer which is also capable of printing on the recording medium having high rigidity may be realized.

The objects described above are also achieved by the image forming device wherein the paper allotting means is comprised of: a first flap member which changes its position by rotation; a second flap member, located above the first flap member, which changes its position by rotation; and a rotation means which rotates the first flap member and the second flap member so as to change a position of each of the first flap member and the second flap member.

The objects described above are also achieved by the image forming device wherein a lower surface of the first flap member forms a portion of the recording medium path which communicates with the switchback portion by blocking an inlet of the second recording medium ejection path which communicates with the second recording medium receiving portion and guides the recording medium to the switchback portion when the first flap member is in substantially a horizontal state, the first flap member and the second flap member form a portion of the second recording medium ejection path which communicates with the second recording medium receiving portion by blocking an inlet of the recording medium path which communicates with the recording medium switchback portion and an inlet of the first recording medium ejection path which communicates with the first recording medium receiving portion, respectively, and guides the recording medium to the second recording medium receiving portion when the first flap member is in an inclined state and the second flap member is also in an inclined state, and an upper surface of the first flap member and a lower surface of the second flap member form a portion of the first recording medium ejection path which communicates with the first recording medium receiving portion by blocking an inlet of the recording medium path which communicates with the recording medium switchback portion and an inlet of the second recording medium ejection path which communicates with the second recording medium receiving portion, respectively, and guides the recording medium to the first recording medium receiving portion when the first flap member is in an inclined state and the second flap member is in substantially a horizontal state.

According to the above image forming device, since the paper allotting means is comprised of a first flap member which changes its position by rotation; a second flap member, located above the first flap member, which changes its position by rotation; and a rotation means which rotates the first flap member and the second flap member so as to change a position of each of the first flap member and the second flap member, one of the first recording medium ejection path which communicates with the first recording medium receiving portion (face-up stacker), the second recording medium ejection path which communicates with the second recording medium receiving portion (face-down stacker), and the recording medium path which communicates with the recording medium switchback portion may be formed by appropriately changing the position of the first flap member and the second flap member so as to form one of the above three paths and blocking the inlets of the other two paths. Thus, a reliability of the operation of the paper allotting means may be improved.

The objects described above are also achieved by the image forming device, wherein the first flap member includes a cam, the second flap member includes an arm, the cam of the first flap member being in contact with the arm of the second flap member when the first flap member is in an inclined state and the second flap member is in substantially a horizontal state, and the second flap member is entered into an inclined state when the first flap member is entered into substantially a horizontal state due to a movement of the arm of the second flap member together with the cam of the first flap member.

According to the above image forming device, since the first flap member includes a cam, the second flap member includes an arm and the second flap member is entered into an inclined state when the first flap member is entered into substantially a horizontal state due to a movement of the arm of the second flap member together with a movement of the cam of the first flap member, only one rotation means is necessary to achieve the above-mentioned operation, and hence the structure of the paper allotting mechanism may be simplified.

The objects described above are also achieved by the image forming device, wherein the rotation means is comprised of a first flap member rotation means for rotating the first flap member, and a second flap member rotation means for rotating the second flap member.

According to the above image forming device, since the rotation means includes the first flap member rotation means and the second flap member rotation means, it is possible to actuate the first and the second flap member rotation means independently of each other.

The objects described above are also achieved by the image forming device, wherein the image forming part is comprised of a photoreceptor drum, and a static elimination means for removing electric charges on the recording medium in two steps is further provided downstream of the photoreceptor drum with respect to a recording medium transfer direction.

According to the above image forming device, since the static elimination means for removing electric charges on the recording medium in two steps is further provided downstream of the photoreceptor drum, it becomes possible to properly remove the electric charges on the recording medium even if the amount of the electric charges is large. As a result, a scattering of printing powder from the photoreceptor drum due to the electrification of a recording medium does not occur before the printing powder is fixed on the recording medium, and a quality of a printed image and the quality of printing may be improved.

Other objects and further features of the present invention will be apparent from the following detailed description when read in conjunction with the accompanied drawings.

BRIEF DESCRIPTION OF THE DRAWINGS

FIG. 10 is a diagram showing a cross-sectional view of a static eliminator, together with other members, (shown in FIGS. 10A–10C) according to the present invention.

DESCRIPTION OF THE PREFERRED EXAMPLES

In the following, a principle and examples of the present invention will be described in detail with reference to accompanied drawings.

Figure 1:
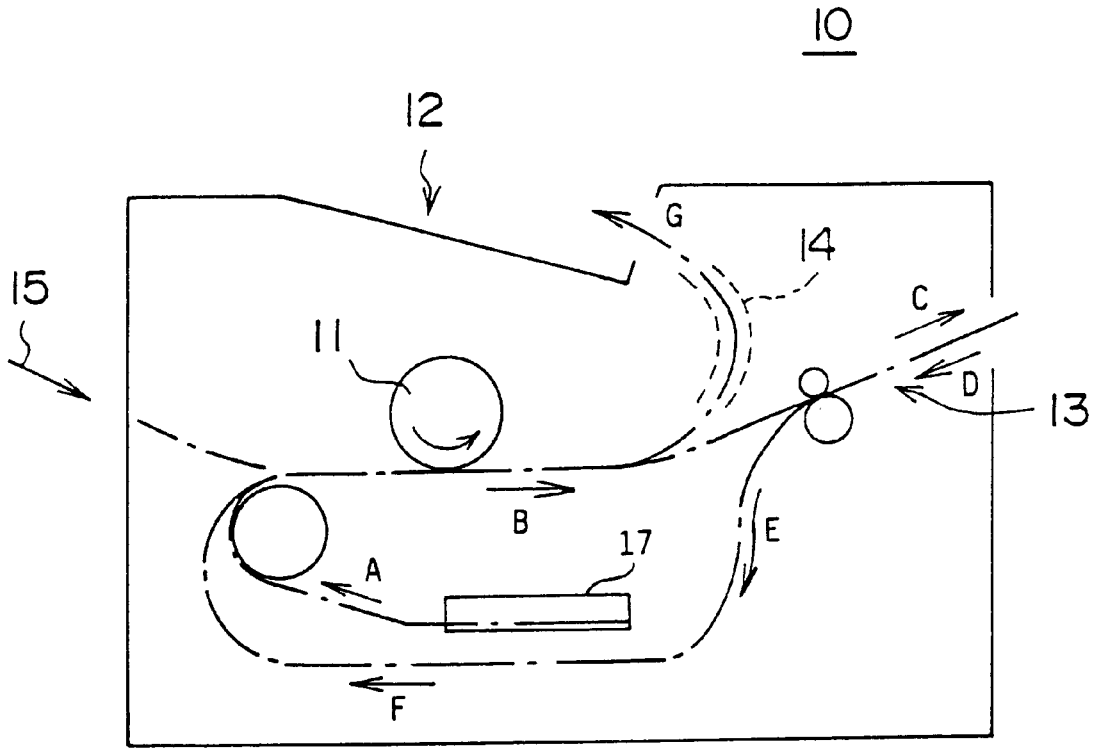
FIG. 1 PRIOR ART
FIG. 1 is a schematic diagram showing a conventional dual-sided printer which is capable of both-side printing.
Figure 2:
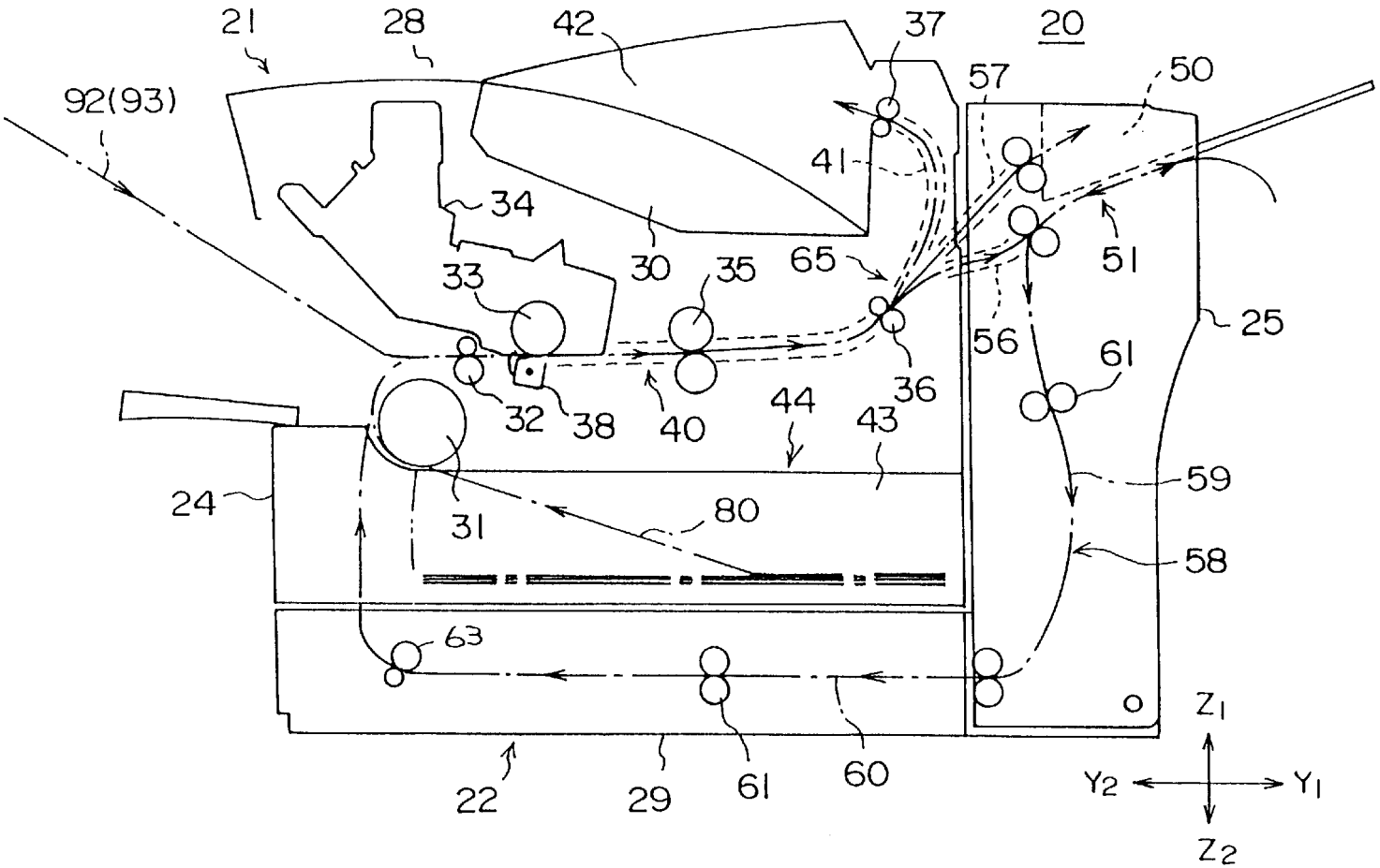
FIG. 2 is a schematic diagram showing a dual-sided printer which is capable of both-side printing according to an embodiment of the present invention.
Figure 3:
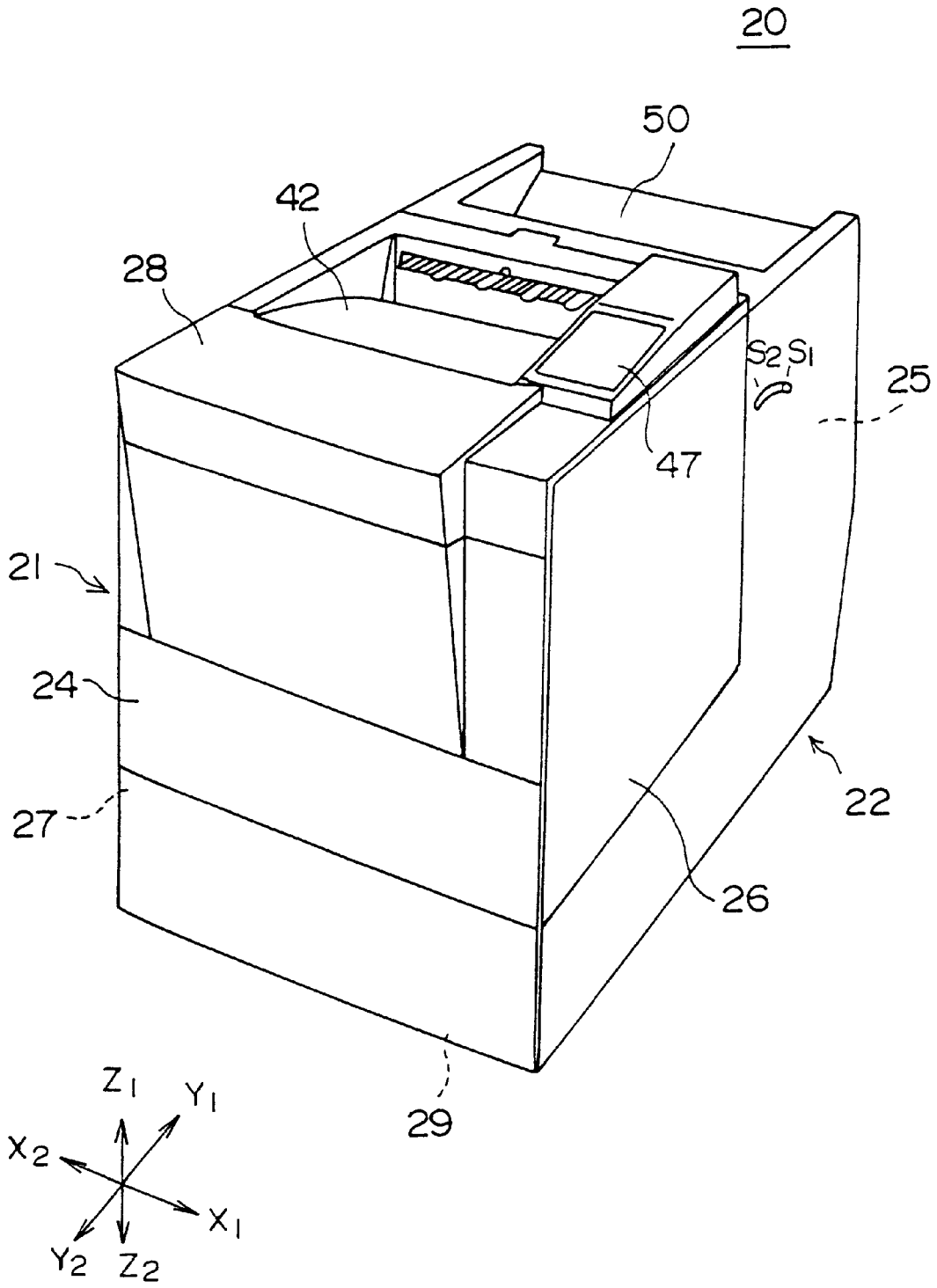
FIG. 3 is a diagram showing a perspective view of the dual-sided printer shown in FIG. 2.
Figure 4:
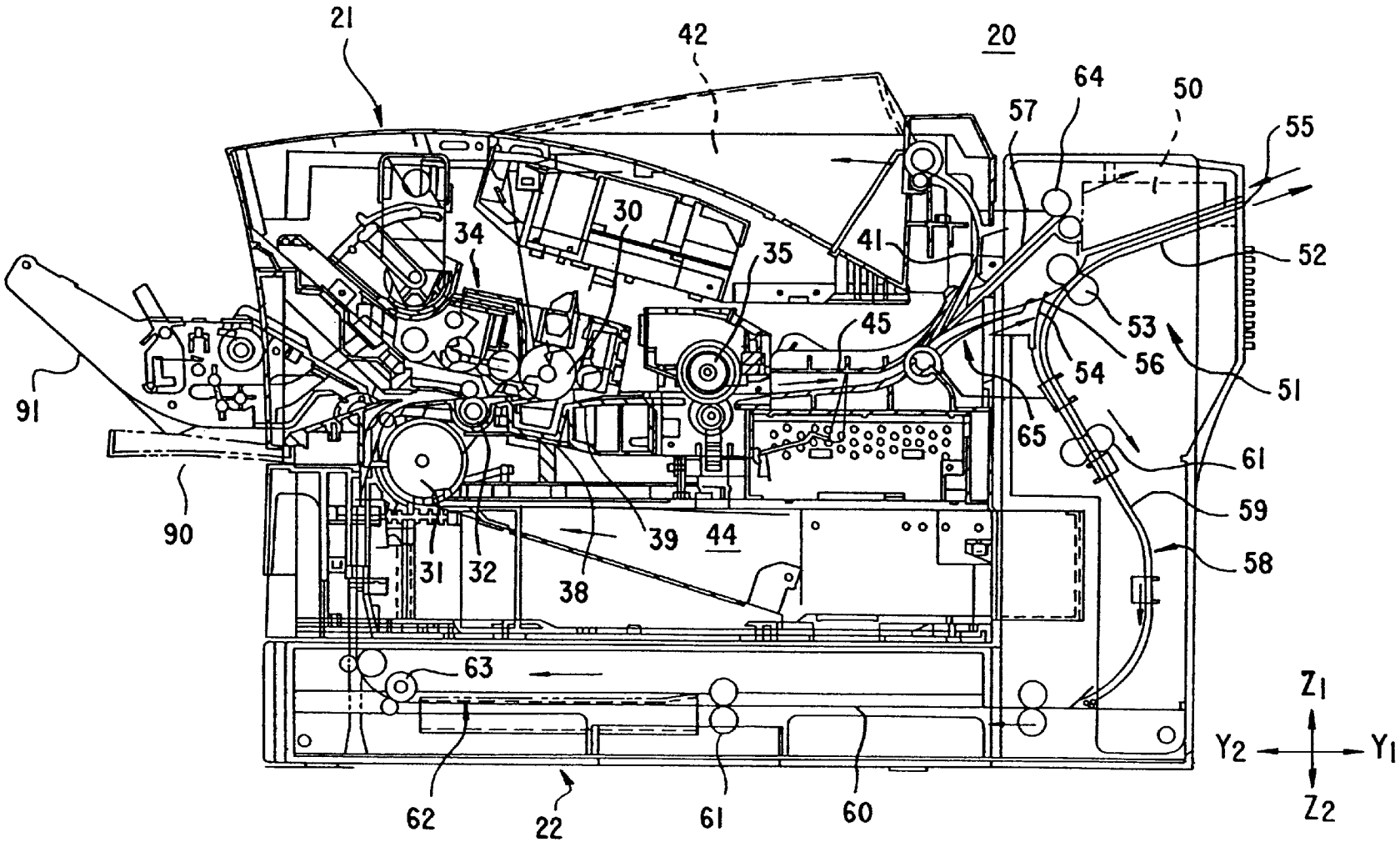
FIG. 4 is a structural diagram of the printer according to the embodiment of the present invention shown in FIGS. 2 and 3.

FIGS. 2 through 4 are diagrams for explaining a dual-sided printer 20 according to an embodiment of the present invention. FIG. 2 shows a schematic diagram of the dual-sided printer 20 and FIG. 3 is a diagram showing a perspective view of the dual-sided printer 20. FIG. 4 is a diagram showing a structure of the dual-sided printer 20.

The dual-sided printer 20 according to an embodiment of the present invention is comprised of a printer body 21, which is capable of only one-side printing, and a both-side printing unit 22 having an L-shape, which may be combined with the printer body 21. The printer body 21 and the both-side printing unit 22 are connected mechanically and electronically.

In the figures, a front surface of the dual-sided printer 20 is indicated by the numeral 24 and it is located in the direction indicated by Y2. Likewise, a back surface, a right-hand surface, and a left-hand surface of the dual-sided printer 20 are indicated by the numerals 25, 26 and 27, respectively, and each of them is located in the direction indicated by Y1, X1 and X2, respectively. Also, an upper surface of the dual-sided printer 20 is indicated by the numeral 28 and it is located in the direction indicated by Z1. Likewise, a lower surface of the printer 20 is indicated by the numeral 29 and it is located in the direction indicated by Z2.

First, the principle structure of the printer body 21 of the dual-sided printer 20 according to the embodiment of the present invention will be described in detail.

The printer body 21 may be comprised of an optical unit 30, a paper feeding roller 31, resist rollers 32, a photoreceptor drum 33, a processing unit 34, fixing members 35, paper sending rollers 36, paper ejection rollers 37, a transferal device 38, a static eliminator 39 and so on. An image forming part according to the present invention may be formed by the optical unit 30, the photoreceptor drum 33, the processing unit 34 and the fixing members 35. As for a paper guiding mechanism of the printer body 21, it may be comprised of a recording path 40 between the resist rollers 32 and the paper sending rollers 36 and a recording medium ejection path 41 for a face-down stacker having substantially an arch shape, located between the paper sending rollers 36 and the paper ejection rollers 37.

Also, the printer body 21 has a face-down stacker 42 located above the recording path 40 (photoreceptor drum 33), and a paper feeding cassette 44, in which paper (or printable matter) 80 is contained, is provided in a space 43 located below the recording path 40 (photoreceptor drum 33). Moreover, an operation panel 47 shown in FIG. 3 is provided on the upper surface 28 of the printer body 21.

Further, an eject sensor 45 is provided substantially midway between the fixing members 35 and the paper sending rollers 36 so as to project in the recording path 40.

Since the face-down stacker 42 is located above the recording path 40 (photoreceptor drum 33) and the photoreceptor 33 and the processing unit 34 are provided on the recording path 40, a printing is performed on the upper surface of a paper 80 when the paper 80 is transferred in the Y1 direction in the printer body 21. Thus, the recording medium ejection path 41 which communicates with the face-down stacker 42 has a curved shape.

Next, the principle structure of the both-side printing unit 22 of the dual-sided printer 20 according to an embodiment of the present invention will be described in detail.

The both-side printing unit 22 includes a face-up stacker 50 provided on its upper surface. The face-up stacker 50 is capable of storing printed papers with the latest printing surface facing upward.

Figure 5:
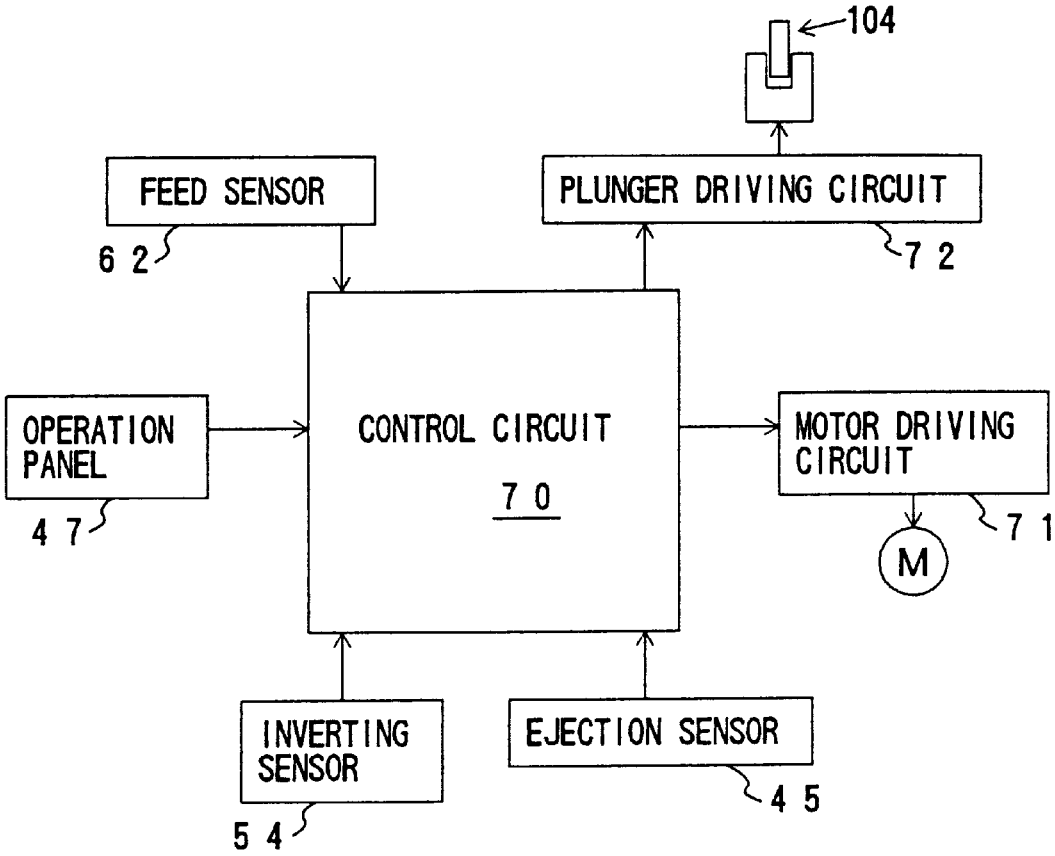
FIG. 5 is a block diagram of a control circuit which may be used in the printer shown in FIG. 4.

Also, the both-side printing unit 22 has a recording medium switchback portion 51 located immediately below the face-up stacker 50. The recording medium switchback portion 51 may be comprised of a paper receiving portion 52, reversible rollers 53 and an inverting sensor 54 as shown in FIG. 5.

The paper receiving portion 52 may be a flat space which may receive a paper 80 of first run, an upper surface of which is printed by passing the recording path 40 (the photoreceptor drum 33). An opening 55 is provided in the back surface 25 direction of the paper receiving portion 52.

The reversible rollers 53 are provided with an inlet of the paper receiving portion 52 in the Y1 direction and, firstly, rotate in a direction so that a paper 80 of first run from the paper sending rollers 36 is transferred in the direction of the paper receiving portion 52 (i.e., substantially the Y1 direction), and then rotate in a reversed direction so that the paper 80 in the paper receiving portion 52 may be transferred in substantially the Y2 direction.

The inverting sensor 54 is located in the Y2 direction from the inlet of the paper receiving portion 52 and projected in a recording medium path 56 for the recording medium switchback portion, which is provided between the paper sending rollers 36 and the paper receiving portion 52 (the recording medium switchback portion 51). The inverting sensor 54 may be rotated in a clockwise direction when pushed by a front end portion of a paper 80 transferring to the paper receiving portion 52 through the recording medium path 56, and is returned to an original position when the other end of the paper 80 has passed the inverting sensor 54. In this manner, the inverting sensor 54 may detect the passing of a paper and, at the same time, function as a guiding member which guides a paper to an inverted recording medium path 58 by blocking the recording medium path 56.

With regard to recording medium paths, the both-side printing unit 22 according to the present invention includes the above-mentioned recording medium path 56, a recording medium ejection path 57 for the face-up stacker and the inverted recording medium path 58.

The recording medium path 56 and the paper receiving portion 52, respectively, extend in between the Y1 and the Z1 directions in substantially straight lines with respect to the paper sending rollers 36.

The recording medium ejection path 57 for the face-up stacker 50 is located just above the recording medium path 56 and makes the paper sending rollers 36 communicate with the face-up stacker 50. Since the face-up stacker 50 is positioned diagonally above the recording path 40 (the photoreceptor drum 33) in the Y1 direction, the recording medium ejection path 57 also extends in the diagonal direction from the paper sending rollers 36. Thus, even when a recording medium having strong rigidity is printed through the recording path 40 passing underneath the photoreceptor drum 33, it may smoothly reach the face-up stacker 50 through the recording medium ejection path 57.

On the other hand, the inverted recording medium path 58 may be comprised of an S-shape portion 59 extending from the reversible rollers 53 in the Z2 direction and a straight portion 60, connected to the S-shape portion 59, extending underneath the printer body 21 in the Y2 direction to resist rollers 63 located below the paper feeding roller 31. Thus, the inverted recording medium path 58 has a substantially L-shape (rotated L-shape at 90 degrees in counterclockwise direction). The S-shape portion 59 has a function to remove curl of a paper 80.

A plurality of paper transfer rollers 61 may be provided with the inverted recording medium path 58. In the vicinity of the end of the straight portion 60, a feed sensor 62 and the resist rollers 63 are provided. The inverted recording medium path 58 and the paper transfer rollers 61 form an inverted recording medium transfer part.

Also, the both-side printing unit 22 includes a paper allotting mechanism 65, located in the vicinity of an outlet portion of the paper sending rollers 36, by which a recording medium supplied from the paper sending rollers 36 is allotted to one of the above-mentioned recording medium ejection path 41 for the face-down stacker, the recording medium path 56 and the recording medium ejection path 57 for the face-up stacker 50. The operation of the paper allotting mechanism 65 will be described later.

Next, a control circuit which may be used in the dual-sided printer 20 according to the present invention will be explained with reference to FIG. 5.

FIG. 5 is a block diagram showing control circuits which may be used for the printer 20. In FIG. 5, a control circuit 70 properly operates a motor driving circuit 71 and a plunger driving circuit 72 in accordance with an order from the operation panel 47 and information from the ejection sensor 45, the inverting sensor 54, the feed sensor 62 and so on. Thus, a motor and a plunger 104 may be appropriately operated. The control circuit 70 may be formed of micro-computers.

Next, the operation of the above-mentioned printer 20 in both-side printing, one-side printing, and one-side printing through the manual paper inlet will be explained as follows.

1. Both Side Printing for a Printing Matter Supplied From the Paper Feeding Cassette 44

When it is ordered to perform the both-side printing of a paper 80 contained in the paper feeding cassette 44 through the operation of the operating panel 47, the paper feeding roller 31 is rotated and the paper 80 is supplied from the paper feeding cassette 44. The position of the paper 80 is corrected when it reaches the resist rollers 32. Then, the paper 80 is transferred through the recording path 40 in the Y1 direction at a printing velocity and a printing operation (first run) is performed on its upper surface via the photoreceptor drum 33, on which electrostatic images are formed by the optical unit 30, and the fixing members 35.

The paper 80, the upper surface of which is printed by the above-mentioned operation, is exited from the recording path 40 by the paper sending rollers 36 and reaches the paper allotting mechanism 65 by which it is selected to be sent to the recording medium path 56 (among the recording medium path 56 and the ejection paths 41 and 57 to be described later). The paper 80 which has entered the recording medium path 56 is transferred by the reversible rollers 53 to the paper receiving portion 52. The inverting sensor 54 detects when the back end of the paper 80 reaches the position of the reversible rollers 53.

When the inverting sensor 54 detects the back-end of the paper 80, the rotation of the reversible rollers 53 is reversed and the paper 80 is transferred from the paper receiving portion 52 to the inverted recording medium path 58, guided by the inverting sensor 54. After this, the paper 80 is transferred through the inverted recording medium path 58, first, in the Z2 direction by the paper transfer rollers 61 and then in the Y2 direction to reach the resist rollers 63 where the position of the paper 80 is corrected.

Then, the paper 80 is transferred in the Z1 direction by the paper transfer rollers 61 and the resist rollers 63, passing the paper feeding roller 31, and reaches the resist rollers 32 where its position is corrected once again. After the above operation, the paper 80 is moved through the recording path 40 in the Y1 direction at a printing velocity and a printing operation (second run) is performed on its upper surface (the other side) via the photoreceptor drum 33, on which electrostatic images are formed by the optical unit 30, and the fixing members 35.

The paper 80, both sides of which are printed by the above-mentioned operation, is exited from the recording path 40 by the paper sending rollers 36 and reaches the paper allotting mechanism 65 by which it is sent to the recording medium ejection path 41, instead of the recording medium path 56 this time (to be described later). The paper 80, which has entered the recording medium ejection path 41, is transferred by the paper ejection rollers 37 and ejected on the face-down stacker 42. This is the end of the both-side printing operation of the paper 80.

2. One Side Printing for a Printing Matter Supplied From the Paper Feeding Cassette 44

When it is ordered to perform the one-side printing of a paper 80 contained in the paper feeding cassette 44 through the operation of the operating panel 47, the paper feeding roller 31 is rotated and the paper 80 is supplied from the paper feeding cassette 44. The position of the paper 80 is corrected when it reaches the resist rollers 32. Then, the paper 80 is transferred through the recording path 40 in the Y1 direction at a printing velocity and a printing operation is performed on its upper surface via the photoreceptor drum 33, on which electrostatic images are formed by the optical unit 30, and the fixing members 35.

The paper 80, the upper surface of which is printed by the above-mentioned process, is exited from the recording path 40 by the paper sending rollers 36 and reaches the paper allotting mechanism 65 by which it is selected to be sent to the recording medium ejection path 41 (among the recording medium path 56 and the ejection paths 41 and 57 to be described later). The paper 80 which has entered the ejection path 41 is transferred by the paper ejection rollers 37 and ejected on the face-down stacker 42. This is the end of the one-side printing operation of the paper 80.

3. One-Side Printing for a Printing Matter 92 (93) Which Cannot be Supplied From the Paper Feeding Cassette 44

3–1 For the Recording Medium 92 Which has a Normal Thickness Range (Normal Rigidity)

First, a cover 90 located on the front surface 24 of the printer body 21 is opened and a feeder 91 shown in FIG. 4, which may be optionally provided with the printer 20, is fixed. Then, a plurality of recording media 92 are set on the feeder 91 which is capable of feeding the plurality of recording media 92, one by one, into the printer 20. The position of the recording medium 92 is corrected when it has reached the resist rollers 32. Then, the recording medium 92 is transferred through the recording path 40 in the Y1 direction at a printing velocity and a printing operation is performed on its upper surface via the photoreceptor drum 33, on which electrostatic images are formed by the optical unit 30, and the fixing members 35.

The recording medium 92, the upper surface of which is printed by the above-mentioned process, is exited from the recording path 40 by the paper sending rollers 36 and reaches the paper allotting mechanism 65 by which it is selected to be sent to the recording medium ejection path 41 (among the recording medium path 56 and the ejection paths 41 and 57 to be described later). The recording medium 92 which has entered the ejection path 41 is transferred by the paper ejection rollers 37 and ejected on the face-down stacker 42. This is the end of the one-side printing operation of the recording medium 92.

3–2 For the Recording Medium 93 Which has a High Rigidity Such as a Postcard, an OHP Sheet or an Envelope First, similar to the above, the cover 90 located on the front surface 24 of the printer body 21 is opened and the feeder 91 is fixed to the printer body 21. Then, a plurality of recording media 93 are set on the feeder 91 which is capable of feeding the plurality of recording media 93, one by one, into the printer 20. The position of the recording medium 93 is corrected when it has reached the resist rollers 32. Then, the recording medium 93 is transferred through the recording path 40 in the Y1 direction at a printing velocity and a printing operation is performed on its upper surface via the photoreceptor drum 33, on which electrostatic images are formed by the optical unit 30, and the fixing members 35.

The recording medium 93, the upper surface of which is printed by the above-mentioned process, is exited from the recording path 40 by the paper sending rollers 36 and reaches the paper allotting mechanism 65 by which it is selected to be sent to the recording medium ejection path 57 (among the recording medium path 56 and the ejection paths 41 and 57 to be described later). The recording medium 93 which has entered the ejection path 57 is transferred by the paper ejection rollers 64 and ejected on the face-up stacker 50. Since the ejection path 57 is formed in substantially the straight line, the recording medium 93 which has high rigidity may be smoothly transferred through the ejection path 57 without being stacked or jammed. This is the end of the one-side printing operation of the recording medium 93.

Figure 6A:
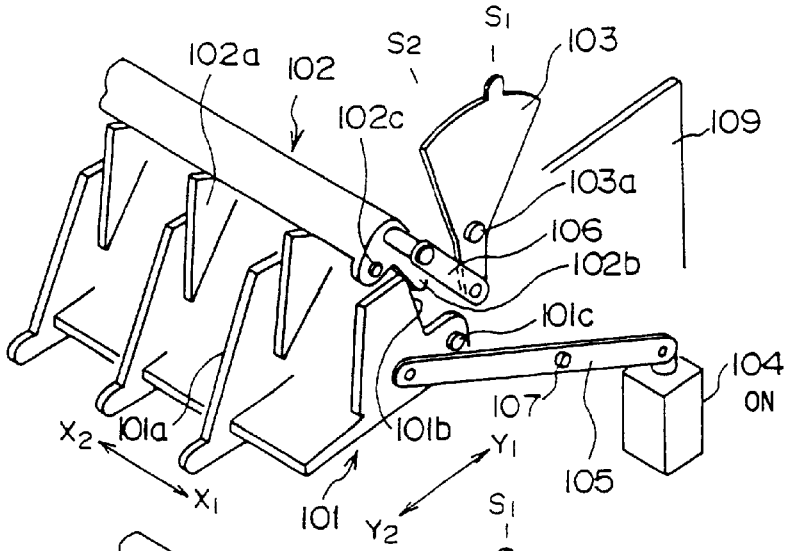
FIG. 6A is a perspective view of a paper allotting mechanism for explaining a first state of the mechanism.

Next, the paper allotting mechanism 65 which forms a paper allotting means according to the present invention will be explained with reference to FIGS. 6A through 6C and FIGS. 7A through 7C. FIG. 6A corresponds to FIG. 7A, FIG. 6B corresponds to FIG. 7B, and FIG. 6C corresponds to FIG. 7C.

The paper allotting mechanism 65 may be comprised of a first flap member 101, a second flap member 102, an operation lever 103, a plunger 104, a lever 105 and a link 106. The plunger 104, together with the lever 105, forms a rotary means.

The first flap member 101 is comprised of a plurality of flaps 101*a* which are provided in the X1–X2 direction with a spacing between each other as shown in FIG. 6A. A cam 101*b* is provided at the X1 end of the first flap member 101 and a shaft 101*c* is rotatably supported by a frame 109 of the both-side printing unit 22.

The second flap member 102 is comprised of a plurality of flaps 102*a* which are provided in the X1–X2 direction with a spacing between each other as shown in FIG. 6A. An arm 102*b* is provided at the X1 end of the second flap member 102 and a shaft 102*c* is rotatably supported by the frame 109 of the both-side printing unit 22.

The plurality of flaps 101*a* of the first flap member 101 and the plurality of flaps 102*a* of the second flap member 102 are located so as to be sandwiched by each other. The cam 101*b* and the arm 102*b* are positioned so as to be opposing each other.

A shaft 103*a* of the operation lever 103 is rotatably supported by the frame 109 and is positioned either in a position S1 or a position S2 as shown in the figures. The operation lever 103 and the second flap member 102 are connected by the link 106.

The plunger 104 is fixed to the frame 109 and is operated as will be described later. The lever 105 is rotatably supported by a shaft 107 which is located on the frame 109. One end of the lever 105 is connected to the plunger 104 and the other end of the lever 105 is connected to the first flap member 101.

Figure 6B:
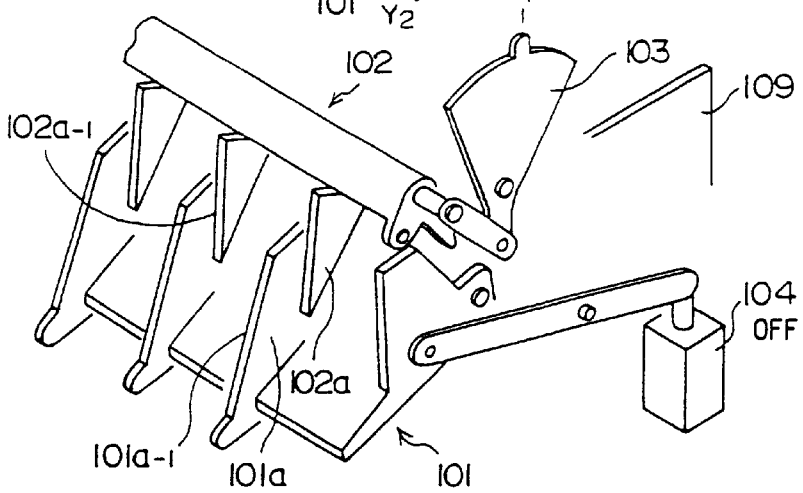
FIG. 6B is a perspective view of the paper allotting mechanism for explaining a second state of the mechanism.
Figure 6C:
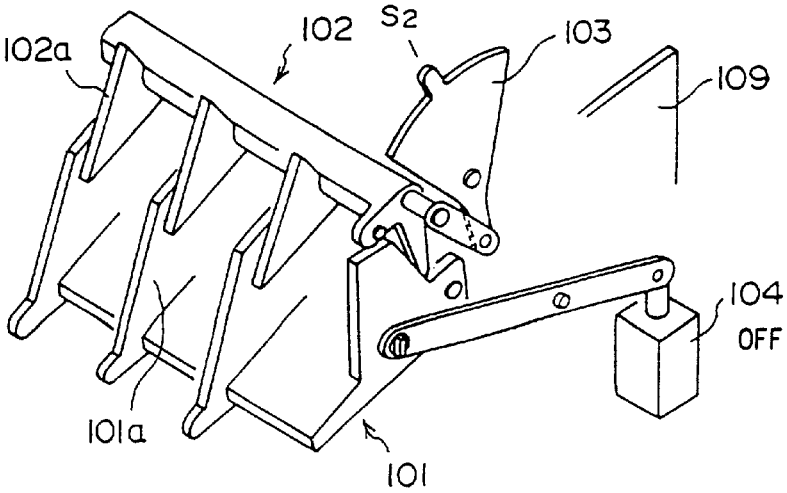
FIG. 6C is a perspective view of the paper allotting mechanism for explaining a third state of the mechanism.
Figure 7A:
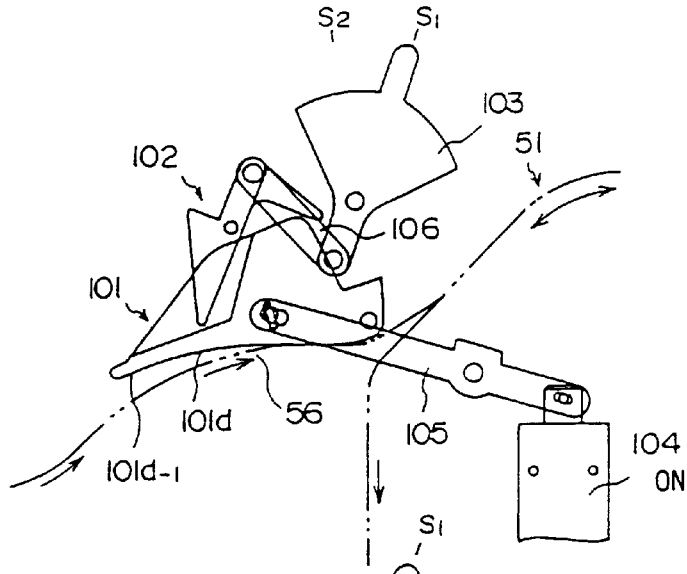
FIG. 7A is a lateral view of the paper allotting mechanism for explaining the first state of the mechanism.
Figure 7B:
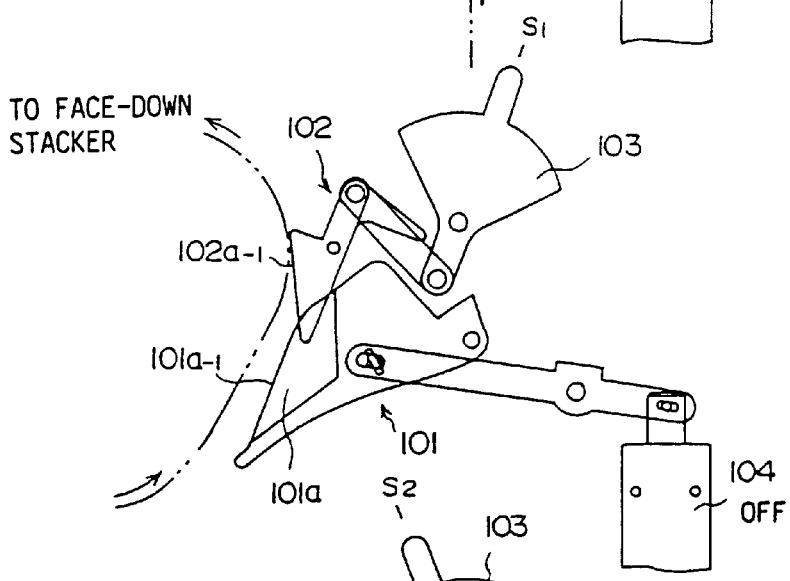
FIG. 7B is a lateral view of the paper allotting mechanism for explaining the second state of the mechanism.
Figure 7C:
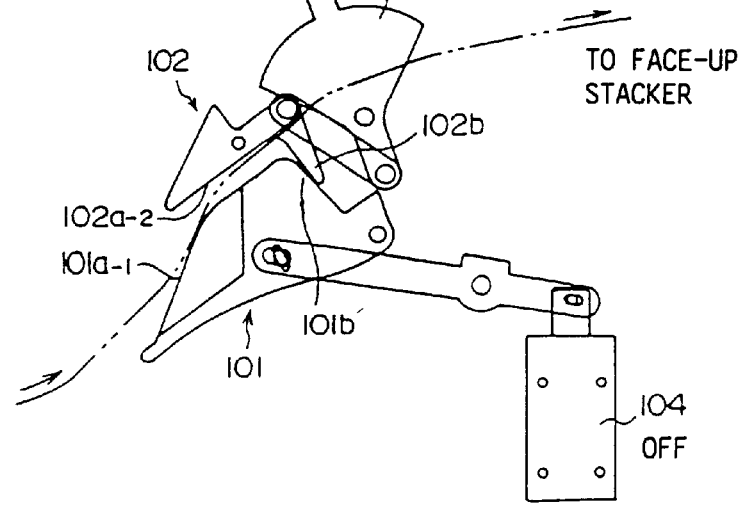
FIG. 7C is a perspective view of the paper allotting mechanism for explaining the third state of the mechanism.

There are three different states of the paper allotting mechanism 65. In the first state, a recording medium is allotted to the paper receiving portion 52 as shown in FIG. 6A and FIG. 7A. In the second state, a recording medium is allotted to the face-down stacker 42 as shown in FIG. 6B and FIG. 7B. In the third state, a recording medium is allotted to the face-up stacker 50 as shown in FIG. 6C and FIG. 7C.

Each of the above-mentioned three states will be described as follows.

FIRST STATE

A Recording Medium is Allotted to the Paper Receiving Portion 52, as Shown in FIG. 6A and FIG. 7A In this state, the plunger 104 is switched on and the operating lever 103 is located at the position S1. Since the plunger 104 is switched on, the first flap member 101 is rotated in the clockwise direction and in substantially the horizontal state. A portion 101*d*-1 located at a tip of a lower surface 101*d* of the first flap member 101 closes an inlet of the recording medium ejection path 41 because of the substantially horizontal state of the first flap member 101, and the lower surface 101*d* of the first flap member 101 forms a portion of the recording medium path 56 guiding a recording medium which is fed by the paper sending rollers 36.

Also, since the operation lever 103 is located at the position S1, the second flap member 102 is rotated in the counter clockwise direction so that the plurality of the flaps 101*a* and the flaps 102*a* are crossed as shown in FIG. 6A, the inlet of the ejection path 57 is closed.

Thus, in the first state, a recording medium which is supplied from the recording path 40 by the paper sending rollers 36 in substantially the Y1 direction contacts the lower surface 101*d* of the first flap member 101 so as to be guided in the recording medium path 56 and reaches the paper receiving portion 52 through the recording medium path 56. Since the inlet of the recording medium ejection path 41 is closed by the portion 101*d*-1 of the lower surface 101*d*of the first flap member 101, the recording medium cannot enter the recording medium ejection path 41, and hence cannot enter the recording medium ejection path 57.

SECOND STATE

A Recording Medium is Allotted to the Face-Down Stacker 42, as Shown in FIG. 6B and FIG. 7B In this state, the plunger 104 is switched off and the operating lever 103 is located at the position S1. Since the plunger 104 is switched off, the first flap member 101 is rotated in the counterclockwise direction and in substantially the inclined state. The portion 101*d*-1 located at a tip of the lower surface 101*d* of the first flap member 101 closes an inlet of the recording medium path 56 because of the substantially inclined state of the first flap member 101.

Also, since the operation lever 103 is located at the position S1, the second flap member 102 is rotated in the counterclockwise direction so that the plurality of the flaps 101*a* and the flaps 102*a* are crossed as shown in FIG. 6B, the inlet of the ejection path 57 is closed.

An upper surface 101*a*-1 of the flap 101*a* of the first flap member 101 in substantially the inclined state and an upper surface 102*a*-1 of the flap 102*a* of the second flap member 102 which is rotated in the counterclockwise direction form a portion of the recording medium ejection path 41.

Thus, in the second state, a recording medium which is supplied from the recording path 40 by the paper sending rollers 36 in substantially the Y1 direction contacts the upper surface 101*a*-1 of the flap 101*a* (or the upper surface 102*a*-1 of the flap 102*a*) so as to be guided in the recording medium ejection path 41 and reaches the face-down stacker 42 through the recording medium ejection path 41. Since the inlet of the recording medium path 56 is closed by the portion 101*d*-l of the lower surface 101*d* of the first flap member 101, the recording medium cannot enter the recording medium path 56. Also, since the inlet of the ejection path 57 is closed by the plurality of the flaps 101*a* and the flaps 102*a*, the recording medium cannot enter the recording medium ejection path 57.

THIRD STATE

A Recording Medium is Allotted to the Face-Up Stacker 50, as Shown in FIG. 6C and FIG. 7C In this state, the plunger 104 is switched off and the operating lever 103 is located at the position S2. Since the plunger 104 is switched off, the first flap member 101 is rotated in the counterclockwise direction and in substantially the inclined state as in the second state and the portion 10l*d*-1 located at a tip of the lower surface 101*d* of the first flap member 101 closes an inlet of the recording medium path 56 because of the substantially inclined state of the first flap member 101.

Also, since the operation lever 103 is located at the position S2, the second flap member 102 is rotated in the clockwise direction from the position shown in FIGS. 6B and 7B so that the second flap member 102 is closer to substantially the horizontal state. Therefore, the plurality of the flaps 101*a* and the flaps 102*a* are no longer crossed as shown in FIG. 7C and the inlet of the ejection path 57 is opened.

Thus, in the third state, a recording medium which is supplied from the recording path 40 by the paper sending rollers 36 in substantially the Y1 direction contacts the upper surface 101*a*-1 of the flap 101*a* and is guided to a lower surface 102*a*-2 of the flap 102*a* so as to be guided in the recording medium ejection path 57 and reaches the face-up stacker 50 through the recording medium ejection path 57. Since the inlet of the recording medium path 56 is closed by the portion 101*d*-1 of the lower surface 101*d* of the first flap member 101, the recording medium cannot enter the recording medium path 56. Also, since the inlet of the ejection path 41 is closed by the plurality of the flaps 102*a,* the recording medium cannot enter the recording medium ejection path 41.

Moreover, since the cam 101*b* of the first flap member 101 and the arm 102*b* of the second flap member 102 are in contact, the cam 101*b* pushes the arm 102*b* when the plunger 104 is switched on and the first flap member 101 is rotated in the clockwise direction. Thus, the second flap member 102 is rotated in the counterclockwise direction and enters the first state shown in FIGS. 6A and 7A without operating the operation lever 103. That is, according to the present invention, it is not necessary to provide a plunger which is switched on in synchronization with the plunger 104 and rotates the operation lever 103 to the position S2.

Figure 8:
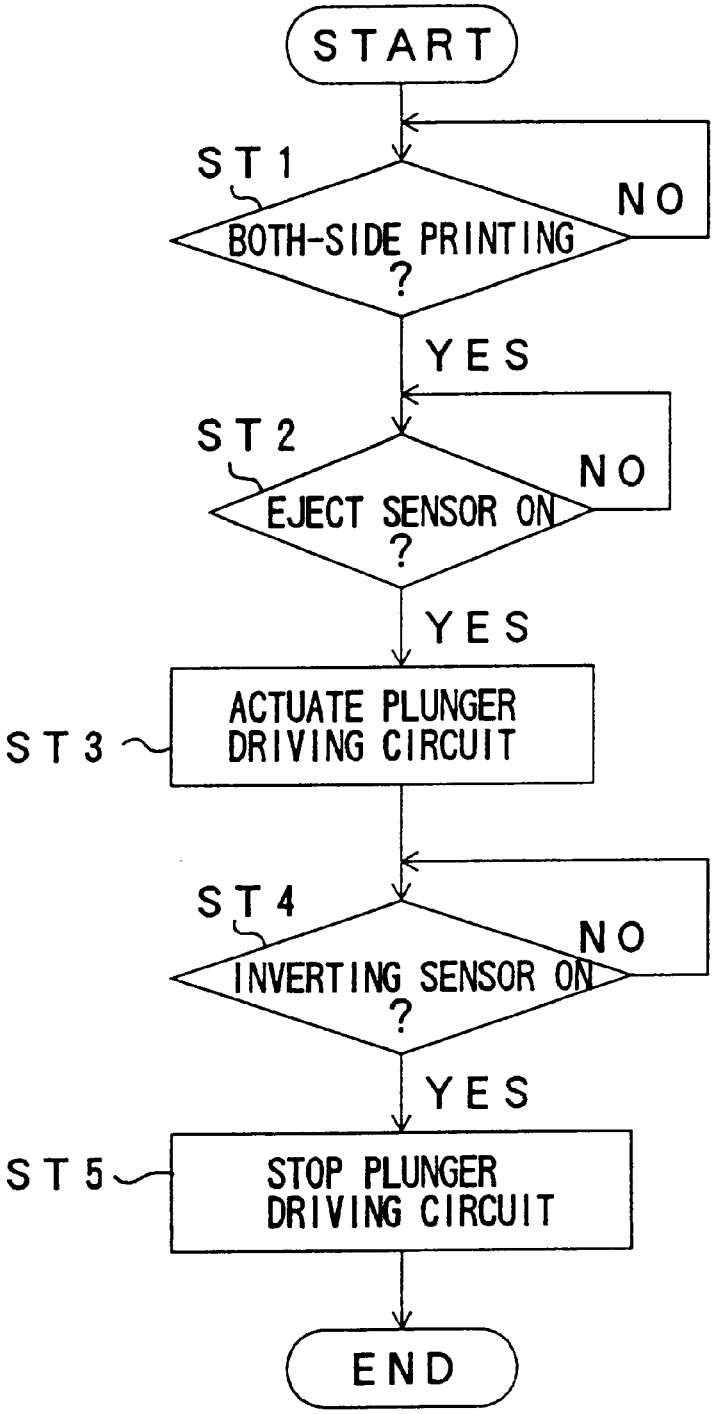
FIG. 8 is a flowchart for explaining an operation of the control circuit according to the present invention.

Next, an operation of the control circuit (microcomputer) 70 used for operating (the plunger 104 of) the paper allotting mechanism 65 will be explained with reference to FIG. 8. Note that a basic state of the paper allotting mechanism 65 is as shown in FIGS. 6B and 7B.

When an order of a both-side printing is input through the operating panel 47 (ST1), it is determined if the eject sensor 47 is turned on or not (ST2) and when the eject sensor 45 is turned on, the plunger driving circuit is actuated (ST3).

Then, it is determined if the inverting sensor 54 is turned on (ST4), and when the inverting sensor 54 is turned on, the operation of the plunger driving circuit is turned off (ST5).

Next, an operation of the paper allotting mechanism 65 when printing on a recording medium having high rigidity such as a postcard, an OHP sheet, or an envelope will be explained.

In the above-mentioned case, the position of the operation lever 103 is set to the position S2. By this operation, the second flap member 102 is rotated via the link 106 in the clockwise direction from the position shown in FIGS. 6B and 7B to the position shown in FIGS. 6C and 7C. Thus, when th position of the operating lever 103 is set to the position S2, the paper allotting mechanism 65 enters the state shown in FIGS. 6C and 7C.

Figure 9:
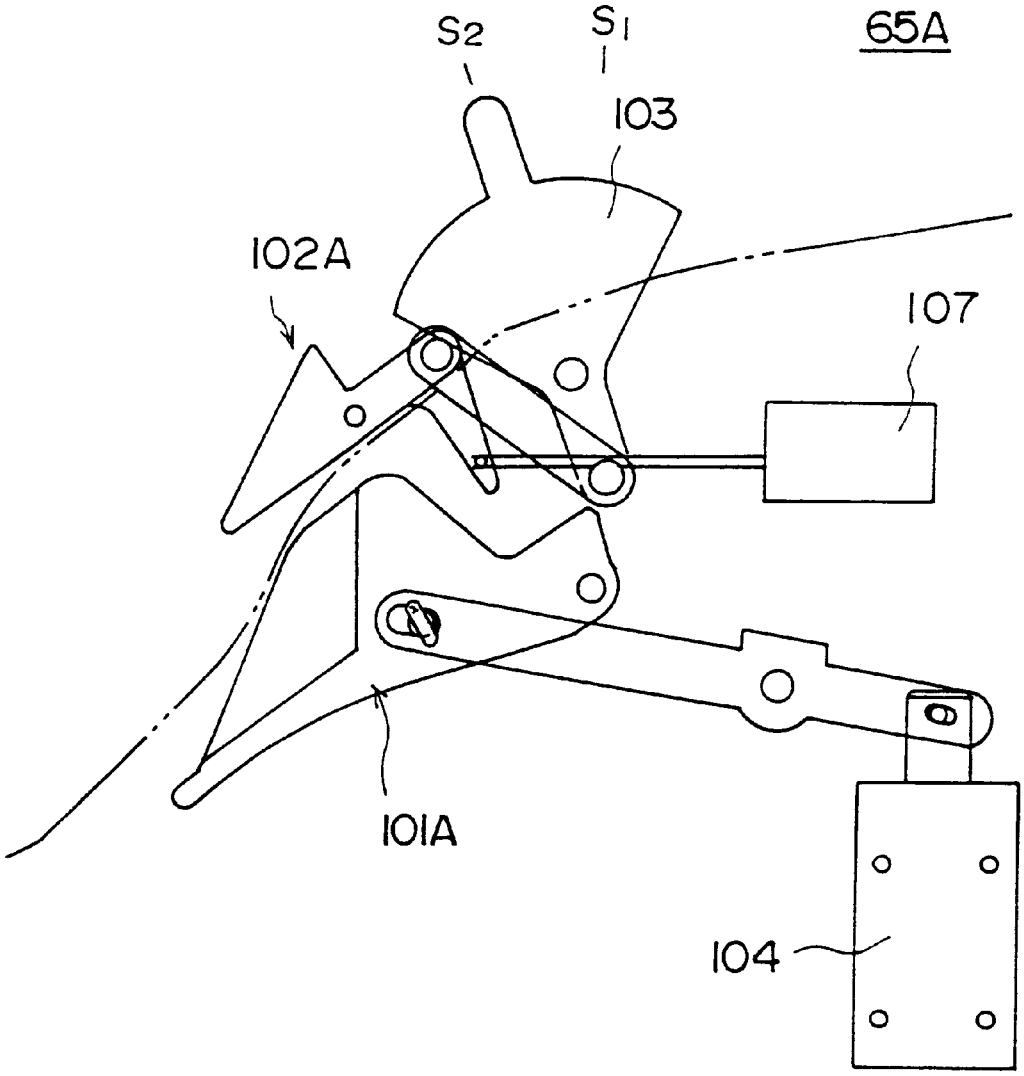
FIG. 9 is a diagram showing a modified embodiment of the paper allotting mechanism according to an embodiment of the present invention.

FIG. 9 shows a modified embodiment of the paper allotting mechanism 65. As shown in FIG. 9, a modified paper allotting mechanism 65A is comprised of a second flap member 102A, which does not have the above-mentioned cam 101*b,* and a plunger 107 which rotates the first flap member 101.

The control circuit (microcomputer) 70 actuates the plunger driving circuit so as to turn on both the plunger 104 and the plunger 107 when the eject sensor 45 is turned on.

Figure 11:
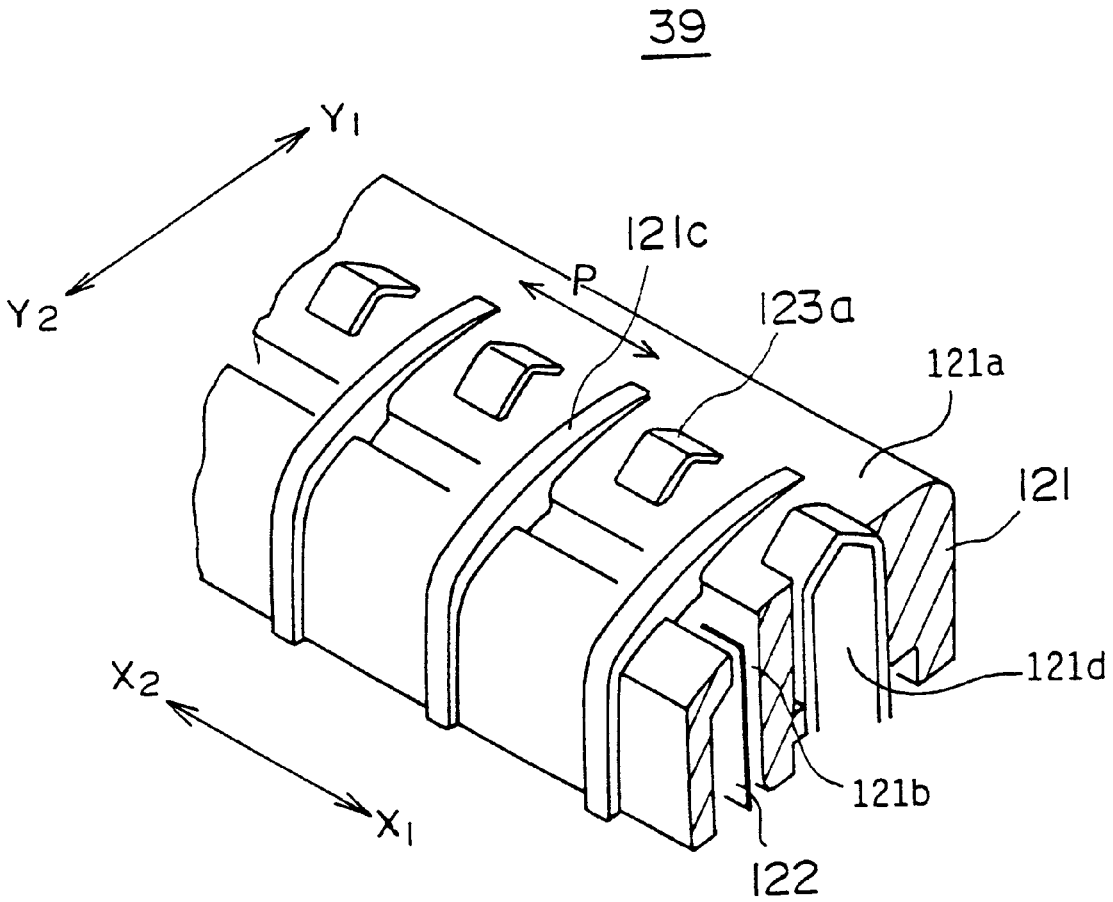
FIG. 11 is a diagram showing a perspective view of the static eliminator shown in FIG. 10.

Next, the static eliminator 39 which is capable of removing electric charges on a recording medium will be explained with reference to FIGS. 10 and 11. FIG. 10 is a diagram for explaining the static eliminator 39 and FIG. 11 is a diagram showing a perspective view of the static eliminator 39.

A recording medium will be electrified during a transfer in the printer 20 due to such cause as friction between the recording medium and the transfer paths. The electrification is more likely to occur as the recording medium gets drier. Since a recording medium is in a dry state after the completion of one-side printing, it is more likely to be electrified when the other side of the recording medium is printed (i.e., both-side printing). If printing powder from the photoreceptor drum 33 is scattered before it is fixed on a recording medium due to the electrification of the recording medium, a quality of a printed image, and hence the quality of printing is lowered.

The static eliminator 39 is provided with the printer 20 in order to eliminate the above-mentioned problems. As shown in FIG. 4, the static eliminator 39 is located between the photoreceptor drum 33 and the fixing members 35 (closer to the photoreceptor drum 33). The static eliminator 39 is characterized by a two-step static elimination acting on a recording medium, which has just passed underneath the photoreceptor drum 33, and removes electric charges on the recording medium so that a powdered image transferred from the photoreceptor drum 33 by the transferal device 38 is not scattered by the electric charges on the recording medium.

The static eliminator 39 may be comprised of a main body 121, a first eliminating member 122, a second eliminating member 123 and a power source 124 as show in FIG. 10. The main body 121 of the static eliminator 39 may be formed of a synthetic resin and the first eliminating member 122, which carries out a first elimination of electric charges on a recording medium, includes a plurality of sharpened portions on its one side as shown in FIG. 10C. The second eliminating member 123, which carries out a second elimination of electric charges on a recording medium, may be made of a metal, and the power source 124 applies a voltage having an opposite polarity to the voltage applied to the transferal device 38 to the first eliminating member 122 and the second eliminating member 123.

The main body 121 of the static eliminator 39 includes an elongated opening 121*b* in the X1–X2 direction and a plurality of ribs 121*c,* each of which is provided with a spacing "p" therebetween, extending in the Y1–Y2 direction are formed on the upper surface 121*a.* Also, a plurality of openings 121*d* are provided between the ribs 121*c,* located next to the elongated opening 121*b* in the Y1 direction.

The first eliminating member 122 is positioned in the elongated opening 121*b* so that the plurality of sharpened portions are facing the upper surface 121*a* of the main body 121.

The second eliminating member 123 may be formed by bending a metal plate and includes a contacting portion 123*a* having a roof shape. The second eliminating member 123 may be injected into each of the openings 121*d* by pressure and the contacting portion 123*a* is projected by "a" from the upper surface 121*c*-1 of the rib 121*c*. The second eliminating member 123 may be located between the adjacent ribs 121*c*.

A recording medium 80, on which images are formed by powder transferred from the photoreceptor drum 33 by the transferal device 38, is passed over the first eliminating member 122 and then contacts the contacting portion 123*a* of the second eliminating member 123 so that the two-step static elimination may be performed. That is, the electric charges on the recording medium 80 are firstly removed by passing over the first eliminating member 122 and then secondly removed by contacting the contacting portion 123*a* of the second eliminating member 123. The recording medium 80 is then transferred in the Y1 direction in a state in which the Z1 and Z2 direction of it are determined.

According to the above static eliminator which carries out the two-step static elimination, an elimination operation may be performed excellently even if the amount of electric charges on the recording medium 80 is large. As a result, a scattering of printing powder on the recording medium 80 may not be caused by the electrification of the recording medium 80 and it becomes possible to achieve an excellent printing quality compared with a conventional printing device.

Also, since the plurality of ribs 121*c* are provided so as to cross the elongated opening 121*b*, it may be possible to avoid catching a front of the recording medium 80 by the elongated opening 121*b*.

Although the present invention has been explained with certain embodiments in which the printer body 21 and the both-side printing unit 22 may be separated, it is possible, of course, to integrally form the printer body and the both-side printing unit from the beginning. Moreover, the present invention may be applied to not only a printer but also a duplicator.

Further, the present invention is not limited to the above-explained embodiments, and variations and modifications may be made without departing from the scope of the present invention.

What is claimed is:

1. An image forming device comprising:

an image forming part which forms an image on a recording medium;

a recording path transferring the recording medium across the image forming part and branching into a recording medium ejection path and a recording medium path;

a stacker collecting the recording medium, the recording medium ejection path transferring the recording medium from the recording path for ejection to the stacker;

a recording medium switchback portion receiving the recording medium from the recording medium path and switching back the recording medium toward the recording path, the recording medium ejection path being adjacent and substantially parallel with a substantially straight path formed by the recording medium path and the recording medium switchback portion; and an inverted recording medium transfer path receiving the recording medium from the recording medium switchback portion and transferring the recording medium back to the recording path.

2. An image forming device according to claim 1, wherein the recording medium ejection path is above the recording medium switchback portion.

3. An image forming device according to claim 1, wherein the recording medium ejection path ejects the recording medium onto an open surface of the stacker, and wherein the recording medium switchback portion extends substantially parallel to and underneath the open surface of the stacker.

4. An image forming device according to claim 1, wherein the stacker is a first stacker collecting the recording medium in a first stacked formation, wherein the recording medium ejection path is a first recording medium ejection path, wherein the recording path branches into the first recording medium ejection path, the recording medium path, and a second recording medium ejection path, and further comprising a second stacker collecting the recording medium in a second stacked formation, the second recording medium ejection path transferring the recording medium from the recording path for ejection to the second stacker.

5. An image forming device according to claim 4 wherein the first stacker is a face-up stacker.

6. An image forming device according to claim 4 wherein the second stacker is a face-down stacker.

7. An image forming device according to claim 4 wherein the first recording medium ejection path is between the second recording medium ejection path and the recording medium switchback portion.

8. An image forming device according to claim 4, further comprising a recording medium allotting mechanism to direct the recording medium to one of the first recording medium ejection path, the second recording medium ejection path, and the recording medium path.

9. An image forming device according to claim 4, further comprising a recording medium allotting mechanism disposed at the location where the recording path branches into the first recording medium ejection path, the second recording medium ejection path, and the recording medium path, the recording medium alloting mechanism including:

a rotatable first flap member having an upper surface and a lower surface;

a rotatable second flap member having an upper surface and a lower surface; and a rotation part which rotates the first and second flap members to direct the recording medium to one of the first recording medium ejection path, the second recording medium ejection path, and the recording medium path, wherein the rotation part rotates the first flap member so that the lower surface of the first flap member directs the recording medium onto the recording medium path which communicates with the recording medium switchback portion, wherein the rotation part rotates the first flap member and the second flap member so that the upper surface of the first flap member and the upper surface of the second flap member cooperatively direct the recording medium onto the second recording medium ejection path, and wherein the rotation part rotates the first flap member and the second flap member so that the upper surface of the first flap member and the lower surface of the second flap member cooperatively direct the recording medium onto the first recording medium ejection path.

10. An image forming device according to claim 9, wherein:

the first flap member includes a cam;

the second flap member includes an arm;

the cam of the first flap member being in contact with the arm of the second flap member when the first flap member is in an inclined state and the second flap member is in a substantially horizontal state; and the second flap member is entered into an inclined state when the first flap member is entered into a substantially horizontal state due to a movement of the arm of the second flap member together with a movement of the cam of the first flap member.

11. An image forming device according to claim 1, wherein said image forming part includes:

a photoreceptor drum; and a static elimination means for removing electric charges on said recording medium in two steps, the static elimination means being provided downstream of the photoreceptor drum.

12. An image forming device comprising:

an image forming part which forms an image on a recording medium;

a recording path transferring the recording medium across the image forming part in a first direction and branching into a first recording medium ejection path, a second recording medium ejection path, and a recording medium path;

a first stacker collecting the recording medium in a first stacked formation, the first recording medium ejection path transferring the recording medium from the recording path for ejection to the first stacker substantially in the first direction;

a second stacker collecting the recording medium in a second stacked formation, the second recording medium ejection path transferring the recording medium from the recording path for ejection to the second stacker in a second direction substantially opposite the first direction;

a recording medium switchback portion receiving the recording medium from the recording medium path and switching back the recording medium towards the recording path in the second direction, the first recording medium ejection path being adjacent and substantially parallel with a substantially straight path formed by the recording medium path and the recording medium switchback portion; and an inverted recording medium transfer path receiving the recording medium from the recording medium switchback portion and transferring the recording medium back to the recording path.

13. An image forming device according to claim 12, wherein the first recording medium ejection path is above the recording medium switchback portion.

14. An image forming device according to claim 12, wherein the first recording medium ejection path is between the second recording medium ejection path and the recording medium switchback portion.

15. An image forming device according to claim 12, wherein the first recording medium ejection path ejects the recording medium onto an open surface of the first stacker, and wherein the recording medium switchback portion extends substantially parallel to and underneath the open surface of the first stacker.

16. An image forming device according to claim 12, wherein the first stacker is a face-up stacker.

17. An image forming device according to claim 12, wherein the second stacker is a face-down stacker.

18. An image forming device according to claims 12, further comprising a recording medium allotting mechanism to direct the recording medium to one of the first recording medium ejection path, the second recording medium ejection path, and the recording medium path.

19. An image forming device according to claim 12, further comprising a recording medium allotting mechanism disposed at the location where the recording path branches into the first recording medium ejection path, the second recording medium ejection path, and the recording medium path, the recording medium alloting mechanism including:

a rotatable first flap member having an upper surface and a lower surface;

a rotatable second flap member having an upper surface and a lower surface; and a rotation part which rotates the first and second flap members to direct the recording medium to one of the first recording medium ejection path, the second recording medium ejection path, and the recording medium path, wherein the rotation part rotates the first flap member so that the lower surface of the first flap member directs the recording medium onto the recording medium path which communicates with the recording medium switchback portion, wherein the rotation part rotates the first flap member and the second flap member so that the upper surface of the first flap member and the upper surface of the second flap member cooperatively direct the recording medium onto the second recording medium ejection path, and wherein the rotation part rotates the first flap member and the second flap member so that the upper surface of the first flap member and the lower surface of the second flap member cooperatively direct the recording medium onto the first recording medium ejection path.

20. An image forming device according to claim 19, wherein:

the first flap member includes a cam;

the second flap member includes an arm;

the cam of the first flap member being in contact with the arm of the second flap member when the first flap member is in an inclined state and the second flap member is in a substantially horizontal state; and the second flap member is entered into an inclined state when the first flap member is entered into a substantially horizontal state due to a movement of the arm of the second flap member together with a movement of the cam of the first flap member.

21. An image forming device according to claim 12, wherein said image forming part includes:

a photoreceptor drum; and a static elimination means for removing electric charges on said recording medium in two steps, the static elimination means being provided downstream of the photoreceptor drum in the first direction.

* * * * *